US010077910B2

(12) United States Patent
Lee et al.

(10) Patent No.: US 10,077,910 B2
(45) Date of Patent: Sep. 18, 2018

(54) OUTDOOR DEVICE FOR AN AIR CONDITIONER

(71) Applicant: LG ELECTRONICS INC., Seoul (KR)

(72) Inventors: Hoki Lee, Seoul (KR); Hyunjun Lim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 221 days.

(21) Appl. No.: 14/850,248

(22) Filed: Sep. 10, 2015

(65) Prior Publication Data

US 2016/0076779 A1 Mar. 17, 2016

(30) Foreign Application Priority Data

Sep. 12, 2014 (KR) ..... 10-2014-0120979
Apr. 6, 2015 (KR) ..... 10-2015-0048237

(51) Int. Cl.

| | |
|---|---|
| ***F25D 23/12*** | (2006.01) |
| ***F24F 1/56*** | (2011.01) |
| ***F24F 1/10*** | (2011.01) |
| ***F24F 1/16*** | (2011.01) |
| ***F24F 1/46*** | (2011.01) |
| ***F24F 1/36*** | (2011.01) |

(52) U.S. Cl.

CPC ..... *F24F 1/56* (2013.01); *F24F 1/10* (2013.01); *F24F 1/16* (2013.01); *F24F 1/36* (2013.01); *F24F 1/46* (2013.01); *F25D 23/12* (2013.01)

(58) Field of Classification Search

CPC .... F24F 1/36; F24F 13/222; F24F 1/18; F24F 2011/0089; F24F 1/10; F24F 2013/221

See application file for complete search history.

(56) References Cited

U.S. PATENT DOCUMENTS 4,309,365 A * 1/1982 Van Ness ..... B01D 1/00 261/106
7,971,448 B2 7/2011 Kim et al.
(Continued)

FOREIGN PATENT DOCUMENTS

CN 101586869 11/2009
CN 201348317 11/2009
(Continued)

OTHER PUBLICATIONS

United States Office Action dated Apr 7, 2017 issued in co-pending U.S. Appl. No. 14/851,105.
(Continued)

*Primary Examiner* — Filip Zec
(74) *Attorney, Agent, or Firm* — Ked & Associates LLP

(57) ABSTRACT

An outdoor device for an air conditioner is provided. The outdoor device may include a cabinet, and a base provided at a lower portion of the cabinet. The base may include a base body, on which at least one first seat that supports at least one compressor may be provided, an edge portion disposed along a circumference of the base body and on which at least one second seat that supports a heat exchanger may be disposed, and one or more drain holes defined in the base body to guide discharge of liquid existing in or contained within the base. The at least one first seat and the at least one second seat may be integrated with each other.

33 Claims, 11 Drawing Sheets

(56) References Cited

U.S. PATENT DOCUMENTS

| | | | | |
|---|---|---|---|---|
| 2005/0150247 | A1* | 7/2005 | Ishihara | F24F 1/26 62/507 |
| 2005/0172656 | A1 | 8/2005 | Jung et al. | |
| 2009/0107161 | A1 | 4/2009 | Kim et al. | |
| 2010/0116461 | A1 | 5/2010 | Saito et al. | |
| 2010/0175407 | A1 | 7/2010 | Kim et al. | |
| 2013/0205823 | A1 | 8/2013 | Yagyu | |
| 2014/0131024 | A1 | 5/2014 | Iwazaki et al. | |
| 2014/0298844 | A1 | 10/2014 | Luo et al. | |
| 2014/0338384 | A1 | 11/2014 | Koike | |
| 2015/0000321 | A1 | 1/2015 | Kagawa et al. | |
| 2016/0076779 | A1 | 3/2016 | Lee et al. | |

FOREIGN PATENT DOCUMENTS

| | | | |
|---|---|---|---|
| CN | 101726047 | | 6/2010 |
| CN | 101737868 | | 6/2010 |
| CN | 103822313 | | 5/2014 |
| CN | 102538086 | B | 6/2014 |
| CN | 103917829 | | 7/2014 |
| CN | 103988026 | A | 8/2014 |
| CN | 203823946 | | 9/2014 |
| EP | 2 037 187 | | 3/2009 |
| EP | 2 180 267 | | 4/2010 |
| EP | 2184549 | A2 | 5/2010 |
| EP | 2 206 976 | | 7/2010 |
| EP | 2 738 476 | | 4/2014 |
| EP | 2 733 435 | A2 | 5/2014 |
| EP | 2 995 873 | | 3/2016 |
| JP | H 10-300131 | | 11/1998 |
| JP | H 11-264584 | | 9/1999 |
| JP | 2000-130800 | A | 5/2000 |
| JP | 2012-242026 | A | 12/2012 |
| JP | 5304741 | B2 | 10/2013 |
| JP | 5353998 | B2 | 11/2013 |
| JP | 2014-105954 | | 6/2014 |
| KR | 10-2006-0083016 | | 7/2006 |
| KR | 10-2008-0056478 | | 6/2008 |
| KR | 10-2009-0040498 | A | 4/2009 |
| KR | 10-2009-0044504 | | 5/2009 |
| KR | 10-1401876 | B1 | 5/2014 |
| KR | 10-2014-0088625 | A | 7/2014 |
| KR | 10-2014-0093755 | A | 7/2014 |
| KR | 10-2014-0094648 | A | 7/2014 |
| WO | WO 2011/027709 | A1 | 3/2011 |
| WO | WO 2011/052318 | A1 | 5/2011 |
| WO | WO 2013/080760 | A1 | 6/2013 |
| WO | WO 2013/088713 | A1 | 6/2013 |

OTHER PUBLICATIONS

European Search Report dated Apr. 15, 2016 issued in Application No. 15195217.3.
Korean Notice of Allowance dated Jun. 23, 2017.
U.S. Office Action issued in U.S. Appl. No. 14/851,105, dated Sep. 20, 2017.
Korean Office Action dated Mar. 18, 2016 issued in Application No. 10-2014-0120978.
Korean Office Action dated Mar. 18, 2016 issued in Application No. 10-2014-0120979.
Korean Office Action dated Apr. 1, 2016 issued in Application No. 10-2015-0048237.
Korean Office Action dated Apr. 1, 2016 issued in Application No. 10-2015-0066090.
European Search Report dated Apr. 5, 2016 issued in Application No. 15184052.7.
European Search Report dated Jun. 23, 2016 issued in Application No. 15 19 5183.7.
European Search Report dated Feb. 18, 2016 issued in Application No. 15184028.7.
United States Office Action dated May 19, 2017 issued in co-pending related U.S. Appl. No. 14/849,043.
United States Office Action dated Jan. 3, 2018 issued in co-pending U.S. Appl. No. 14/856,773.
Chinese Office Action dated Nov. 3, 2017 issued in Application No. 201510388473.8 (with English Translation).
U.S. Appl. No. 14/849,043, filed Sep. 9, 2015, Melvin Jones.
U.S. Appl. No. 14/856,773, filed Sep. 17, 2015, Kirstin U. Oswald.
U.S. Appl. No. 14/851,105, filed Sep. 11, 2015, Harry E. Arant.
Chinese Office Action dated Feb. 1, 2018 (English Translation).
U.S. Office Action issued in U.S. Appl. No. 14/856,773 dated Aug. 1, 2018.

* cited by examiner

OUTDOOR DEVICE FOR AN AIR CONDITIONER

CROSS-REFERENCE TO RELATED APPLICATION(S)

The present application claims priority under 35 U.S.C. 119 and 35 U.S.C. 365 to Korean Patent Application No. 10-2014-0120979, filed in Korea on Sep. 12, 2014, and No. 10-2015-0048237, filed in Korea on Apr. 6, 2015, which are hereby incorporated by reference in their entirety.

BACKGROUND

1. Field

An outdoor device for an air conditioner is disclosed herein.

2. Background

Air conditioners are apparatuses for maintaining air in a predetermined space in a most suitable state according to their use and purpose. In general, such an air conditioner drives a refrigeration cycle in which compression, condensation, expansion, and evaporation processes of a refrigerant are performed to cool or heat a predetermined space.

The predetermined space may be various spaces in which the air conditioner is used. For example, when the air conditioner is located in houses or offices, the predetermined space may be an indoor space of a house or building. On the other hand, when the air conditioner is located in a vehicle, the predetermined space may be a passenger boarding space.

When the air conditioner performs a cooling operation, an outdoor heat exchanger disposed in an outdoor unit or device may function as a condenser, and an indoor heat exchanger disposed in an indoor unit or device may function as an evaporator. On the other hand, when the air conditioner performs a heating operation, the indoor heat exchanger may function as the condenser, and the outdoor heat exchanger may function as the evaporator.

The outdoor device of the air conditioner may include a base that defines a lower outer appearance of the outdoor device. The present Applicant applied for and registered Korea Patent Registration No. KR10-1401876 (hereinafter "related art document"), registered in Korea on May 23, 2014 and entitled "Base Assembly of Outdoor Unit of Air Conditioner", in which a base of an outdoor device is disclosed and which is hereby incorporated by reference. However, in the base of the outdoor device of the air conditioner according to the related prior document, defrosting water or rainwater may be stagnant in the base, and thus, may be frozen, causing a bad effect on an operation of the outdoor device.

BRIEF DESCRIPTION OF THE DRAWINGS

Embodiments will be described in detail with reference to the following drawings in which like reference numerals refer to like elements, and wherein.

DETAILED DESCRIPTION

Figure 1:
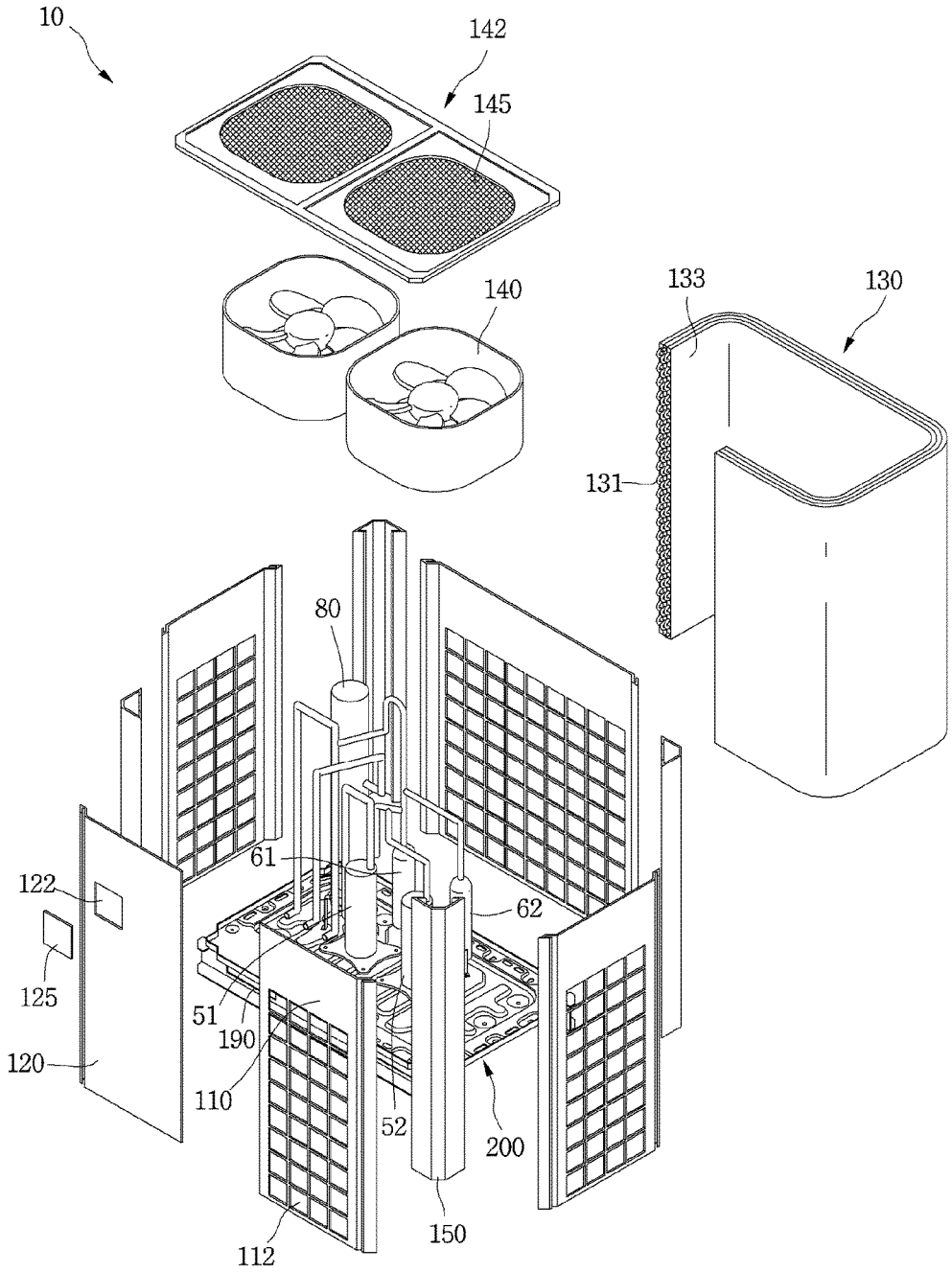
FIG. 1 is an exploded perspective view of an outdoor device for an air conditioner according to an embodiment.
Figure 2:
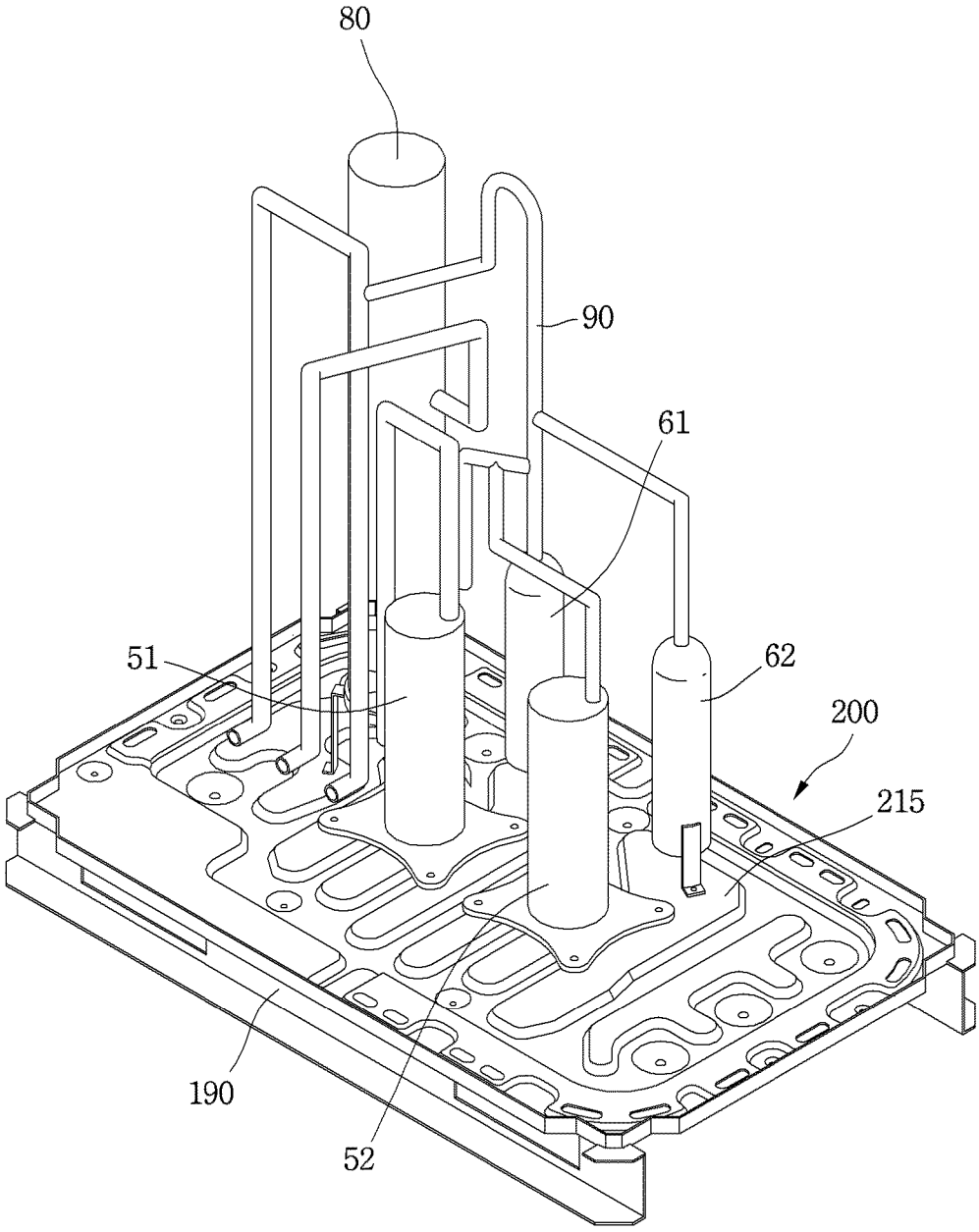
FIG. 2 is a perspective view illustrating a state in which a plurality of components are disposed on a base of the outdoor device of FIG. 1.

FIG. 1 is an exploded perspective view of an outdoor device for an air conditioner according to an embodiment. FIG. 2 is a perspective view illustrating a state in which a plurality of components are disposed on a base of the outdoor device of FIG. 1.

Referring to FIGS. 1 and 2, an outdoor device 10 of an air conditioner according to an embodiment may include a base 200 that defines a lower outer appearance of the outdoor device 10 and that supports a plurality of components provided in the outdoor device 10, a plurality of legs 190 provided on or at a lower portion of the base 200 to allow the outdoor device 10 to be supported at an installation space, and a cabinet 110, 120, and 150 provided on an upper portion of the base 200. The plurality of legs 190 may be disposed on sides of the lower portion of the base 200 and then placed on the installation space, for example, on the ground.

The cabinet 110, 120, and 150 may include a suction panel 110. A plurality of the suction panel 110 may be provided, and the plurality of suction panels 110 may be provided along a circumference of the base 200. That is, the plurality of suction panels 110 may be disposed to extend in an upward direction from an edge of the base 200.

For example, the plurality of suction panels 110 may be disposed on first, second, third, and fourth sides of the base 200, for example, front and rear sides, and left and right sides. The plurality of suction panels 110 may include a plurality of suction grills 112, through which outdoor air may be introduced into the outdoor device 10. The outdoor air may be introduced into the outdoor device 10 through the plurality of suction panels 110 from the front and rear sides or left and right sides of the outdoor device 10, for example.

The cabinet 110, 120, and 150 may include a control panel 120. The control panel 120 may be a door openable to provide access to a control box (not shown) provided in the outdoor device 10. For example, the control panel 120 may be rotatably or slidably provided. The control panel 120 may be provided on or at a lateral side of a suction panel 110 disposed at a front side of the outdoor device 10 of the plurality of suction panels 110, for example.

The control panel 120 may include a viewing window 122 through which a display of the control box may be viewable, and a cover member 125 that provides for selective opening of the viewing window 122.

The cabinet 110, 120, and 150 may include a plurality of bracket 150 to support the plurality of suction panels 110 and the control panel 120. The plurality of bracket 150 may be provided to extend in the upward direction from the base 200.

For example, a first bracket of the plurality of brackets 150 may be provided between adjacent suction panels 110 to support the adjacent suction panels 110. That is, the adjacent suction panels 110 and 110 may be coupled to both sides of the first bracket.

A second bracket of the plurality of brackets 150 may be provided between one suction panel 110 and the control panel 120 provided adjacent to the one suction panel 110 to support the one suction panel 110 and the control panel 120. That is, the one suction panel 110 and the control panel 120 may be coupled to both sides of the second bracket.

A heat exchanger 130 may be disposed in the outdoor device 10. The heat exchanger 130 may extend along inner surfaces of the cabinet 110, 120, and 150. That is, the heat exchanger 130 may be bent several times to extend along inner surfaces of the plurality of suction panels 110.

The heat exchanger 130 may include a heat exchange tube 131, through which a refrigerant may flow, and a plurality of heat exchange fins 133 coupled to the heat exchange tube 131 to assist heat exchange of the refrigerant. The heat exchange tube 131 may form at least one portion of a refrigerant tube 90, and the plurality of heat exchange fins 133 may each provide a surface to exchange heat between the refrigerant and air. Outdoor air introduced through the plurality of suction grills 112 of the plurality of suction panels 110 may be heat-exchanged while passing through the heat exchanger 130.

The outdoor device 10 may further include at least one blower fan 140 to introduce or draw in the outdoor air, and a discharge panel 142 provided on or at one side of the at least one blower fan 140. The discharge panel 142 may include at least one discharge grill 145, through which the air may be discharged outside of the outdoor device 10.

The at least one blower fan 140 may be provided in an upper portion of the outdoor device 10. The discharge panel 142 may be provided on an upper portion of the at least one blower fan 140. The air passing through the heat exchanger 130 may flow upward to pass through the at least one blower fan 140 and the discharge panel 142, thereby being discharged outside of the outdoor device 10.

A plurality of components may be provided on an upper portion of the base 200. The base 200 may include seats (see reference numerals 215 and 225 of FIG. 4), on which the plurality of components may be supported.

The plurality of components may include compressors 51 and 52 that compress the refrigerant, oil separators 61 and 62 disposed on or at discharge sides of the compressors 51 and 52 to separate oil contained in the refrigerant, a gas-liquid separator 80 disposed on or at an inlet-side of the compressors 51 and 52 to separate a liquid refrigerant, thereby supplying a gaseous refrigerant into the compressors 51 and 52, and the refrigerant tube 90 connected to the compressors 51 and 52, the oil separators 61 and 62, and the gas-liquid separator 80 to guide a flow of the refrigerant. The compressors 51 and 52 may include a first compressor 51 and a second compressor 52. The oil separators 61 and 62 may include a first oil separator 61 disposed at an outlet-side of the first compressor 51, and a second oil separator 62 disposed at an outlet-side of the second compressor 52.

Hereinafter, the base will be described with reference to the accompanying drawings.

Figure 3:
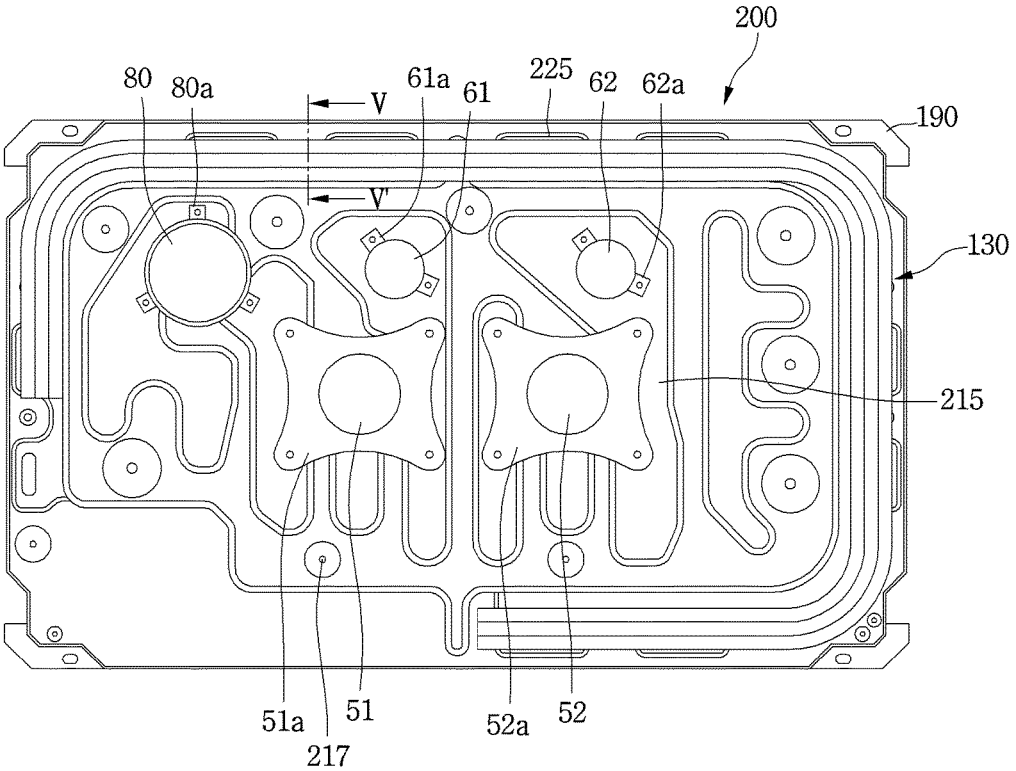
FIG. 3 is a plan view illustrating a state in which the plurality of components are disposed on the base of the outdoor device of FIG. 1.
Figure 4:
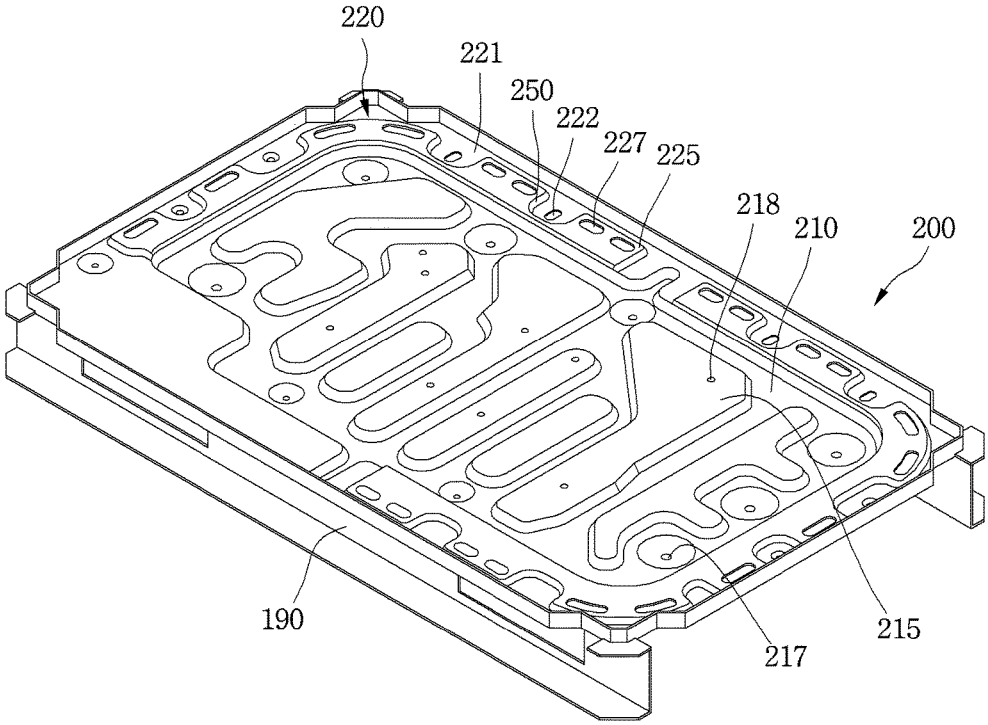
FIG. 4 is a perspective view of the base of the outdoor device of FIG. 1.

FIG. 3 is a plan view illustrating a state in which the plurality of components are disposed on the base of the outdoor device of FIG. 1. FIG. 4 is a perspective view of the base of the outdoor device of FIG. 1.

Referring to FIGS. 3 and 4, the base 200 of the outdoor device 10 according to this embodiment may include a base body 210 that defines a lower outer appearance of the outdoor device 10, and an edge portion 220 disposed on or at an outside of the base body 210. The base 200 may include the seats 215 and 225 that allow at least a portion of the plurality of components to be seated thereon.

The seats 215 and 225 may include a first seat 215 disposed on the base body 210 to allow a first component or components of the plurality of components to be seated thereon, and a second seat 225 disposed on the edge portion 220 to allow a second component or components or the remaining components of the plurality of components to be seated thereon.

The first component or components may be the compressors 51 and 52, the oil separators 61 and 62, and the gas-liquid separator 80 and may be supported by the first seat part 215. For example, the compressors 51 and 52, the oil separators 61 and 62, and the gas-liquid separator 80 may be coupled to the first seat 215.

A plurality of coupling holes 218, to which the compressors 51 and 52, the oil separators 61 and 62, and the gas-liquid separator 80 may be coupled, may be defined in the first seat 215. Each of the compressors 51 and 52, the oil separators 61 and 62, and the gas-liquid separator 80 may include a support fixed to the plurality of coupling holes 218 by, for example, a plurality of coupling members. For example, the supports may include first and second compressor supports 51*a* and 52*a*, respectively, on which the first and second compressors 51 and 52 may be provided, first and second oil separator supports 61*a* and 62*a*, respectively, on which the first and second oil separators 61 and 62 may be provided, and a gas-liquid separator support 80*a*, on which the gas-liquid separator 80 may be provided.

Liquid existing in or contained within the outdoor device 10, for example, defrost water of the heat exchanger 130 or water introduced from the outside, such as rainwater, may be contained in the base body 210. The liquid may be discharged to a lower side of the base body 210 through at least one first drain hole 217 defined in the base body 210. Thus, the base body 210 may be referred to as a "drain pan".

The first seat 215 may protrude in the upward direction from the base body 210. As the compressors 51 and 52, the oil separators 61 and 62, the gas-liquid separator 80 may be supported by the first seat 215, a lower portion of each of the compressors 51 and 52, the oil separators 61 and 62, and the gas-liquid separator 80 may be spaced in the upward direction from the base body 210. Due to the first seat 215, the compressors 51 and 52, the oil separators 61 and 62, the gas-liquid separator 80 may not be affected by the liquid existing in or contained within the base body 210.

The edge portion 220 may extend along a circumference of the base body 210 and be stepped in the upward direction from the base body 210. That is, the edge portion 220 may have an upper surface which is disposed higher than an upper surface of the base body 210.

A step (see reference numeral 219 of FIG. 5) that defines a step difference may be disposed between the base body 210 and the edge portion 220. As the edge portion 220 has the height higher than the height of the base body 210 due to the step 219, the liquid existing in or contained within the base body 210 may be prevented fin flowing into the edge portion 220. Also, the edge portion 220 may extend by a predetermined length from the step 219 toward the outside of the base body 210, or in an outward direction.

The edge portion 220 may include an edge body 221 having the height higher than the height of the base body 210, and the second seat 225 that protrudes in the upward direction from the edge body 221 to allow the heat exchanger 130 to be seated thereon.

The liquid existing in or contained within the outdoor device 10, for example, defrost water of the heat exchanger 130 or water introduced from the outside, such as rainwater, may be contained in the edge body 221. As the second seat 225 is spaced in the upward direction from the edge body 221, a lower portion of the heat exchanger 130 may be spaced in the upward direction from the edge body 221. Thus, the heat exchanger 130 may not be affected by the liquid existing in or contained within the edge body 221.

The base 200 may include a plurality of drain holes 217, 222, and 227. The plurality of drain holes 217, 222, and 227 may include a first drain hole 217 defined in the base body 210, a second drain hole 222 defined in the edge body 221, and a third drain hole 227 defined in the second seat 225. A plurality of each of the first to third drain holes 217, 222, and 227 may be provided, and the plurality of drain holes may be spaced apart from each other.

According to a height difference between the base body 210, the edge body 221, and the second seat 225, the third drain hole 227 may be defined higher than the second drain hole 222, and the second drain hole 222 may be defined higher than the first drain hole 217. Also, each of the first to third drain holes 217, 222, and 227 may include a guide surface (see reference numeral 222*a* of FIG. 5) that extends at an incline or is rounded in a downward direction so that the liquid may easily flow in the downward direction.

The base 200 may further include a blocking portion 250 that defines a step difference between the edge body 221 and the second seat 225 and restricts or forces liquid to flow from the edge body 221 into the base body 210.

Hereinafter, the blocking portion 250 will be described with reference to the accompanying drawings.

Figure 5:
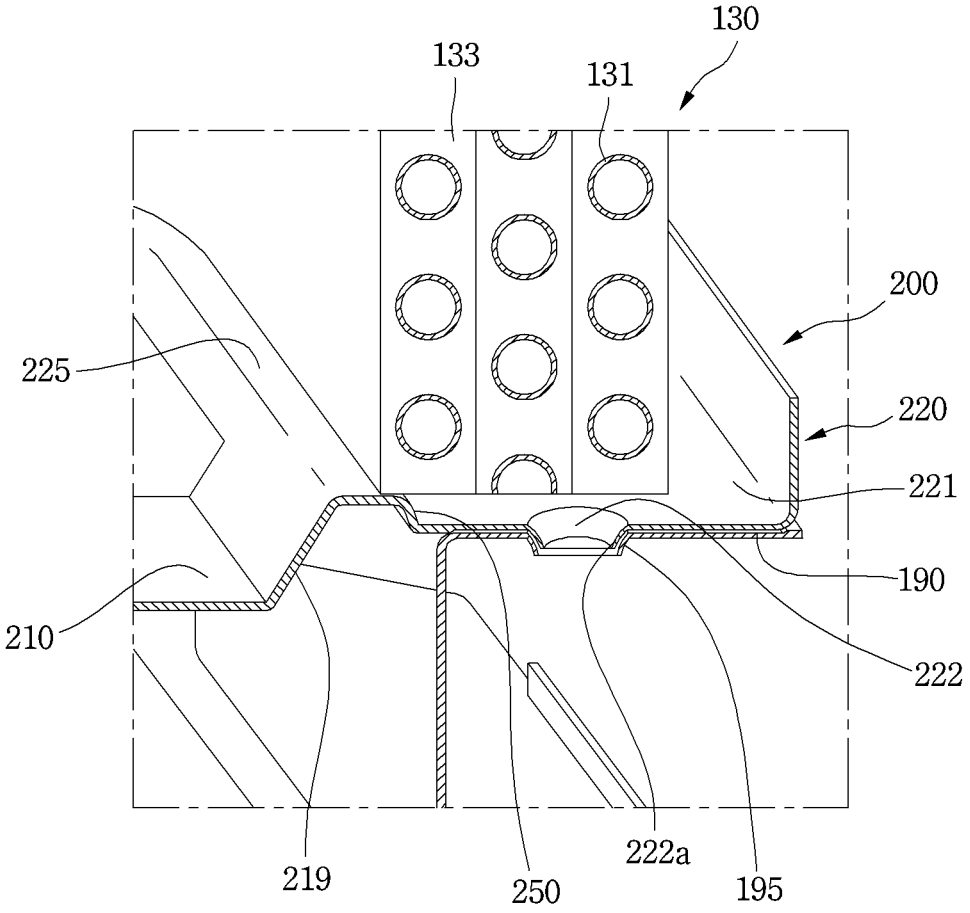
FIG. 5 is a cross-sectional, view taken along line V-V' of FIG. 3.
Figure 6:
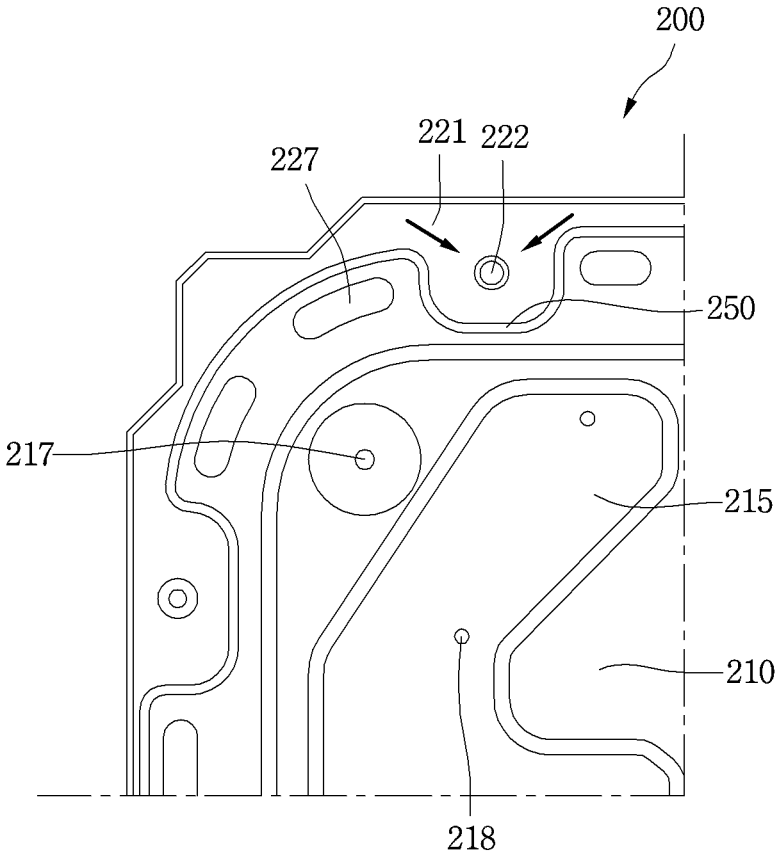
FIG. 6 is a partial plan view illustrating main components of the outdoor device of FIG. 1.

FIG. 5 is a cross-sectional view, taken along line V-V' of FIG. 3. FIG. 6 is a partial plan view illustrating main components of the outdoor device of FIG. 1.

Referring to FIGS. 5 and 6, the base 200 according to this embodiment may include the edge body 221 and the blocking portion 250 that defines the step difference between the edge body 221 and the second seat 225. The blocking portion 250 may extend in the upward direction from the edge body 221 toward the second seat 225. The blocking portion 250 may have a height defined to block liquid so that liquid existing in or contained within the edge body 221 is not introduced into the base body 210.

The step 219 may define a step difference between the base body 210 and the edge portion 220. The step 219 may define a step difference between the base body 210 and the second seat 225. The blocking portion 250 may define a step difference between the edge body 221 and the second seat 225. The step 219 may be referred to as a "first step", and the blocking portion 250 may be referred to as a "second step".

The lower portion of the heat exchanger 130 may be disposed on the second seat 225 and spaced in the upward direction from the second drain hole 222. The plurality of legs 190 may be coupled to a lower portion of the edge portion 220. A leg drain hole 195 that guides the liquid discharged from the edge portion 220 in the downward direction may be defined in each leg 190. The leg drain hole 195 may be defined to correspond to the second and third drain holes 222 and 227.

Referring to FIG. 6, the blocking portion 250 may be disposed adjacent to the second drain hole 222 at an outside of the second drain hole 222. For example, the blocking portion 250 may be spaced a predetermined distance apart from the second drain hole 222 to surround at least a portion of the second drain hole 222.

For example, the defrost water generated by the heat exchanger 130 or the rainwater introduced into the outdoor device 10 may exist in or be contained within the edge body 221. The liquid may be discharged in the downward direction through the second drain hole 222. According to the blocking portion 250, the liquid existing in or contained within the edge body 221 may be restricted or directed to flow into the base body 210 and be guided to the second drain hole 222.

The base body 210 may have a predetermined capability or capacity for drainage processing. When the liquid in the edge body 221 is introduced into the base body 210, an amount of liquid, which is over the preset or predetermined capability or capacity of the base body 210 may exist in or be contained within the base body 210, and thus, the liquid may not be smoothly drained. When the liquid which is not discharged continuously exists or remains in the base body 210, the liquid may freeze according to an outdoor environment. In this embodiment, the blocking portion 250 may be provided to smoothly discharge the liquid remaining in the edge body 221 through the second drain hole 222 to solve the above-described limitations.

Figure 7:
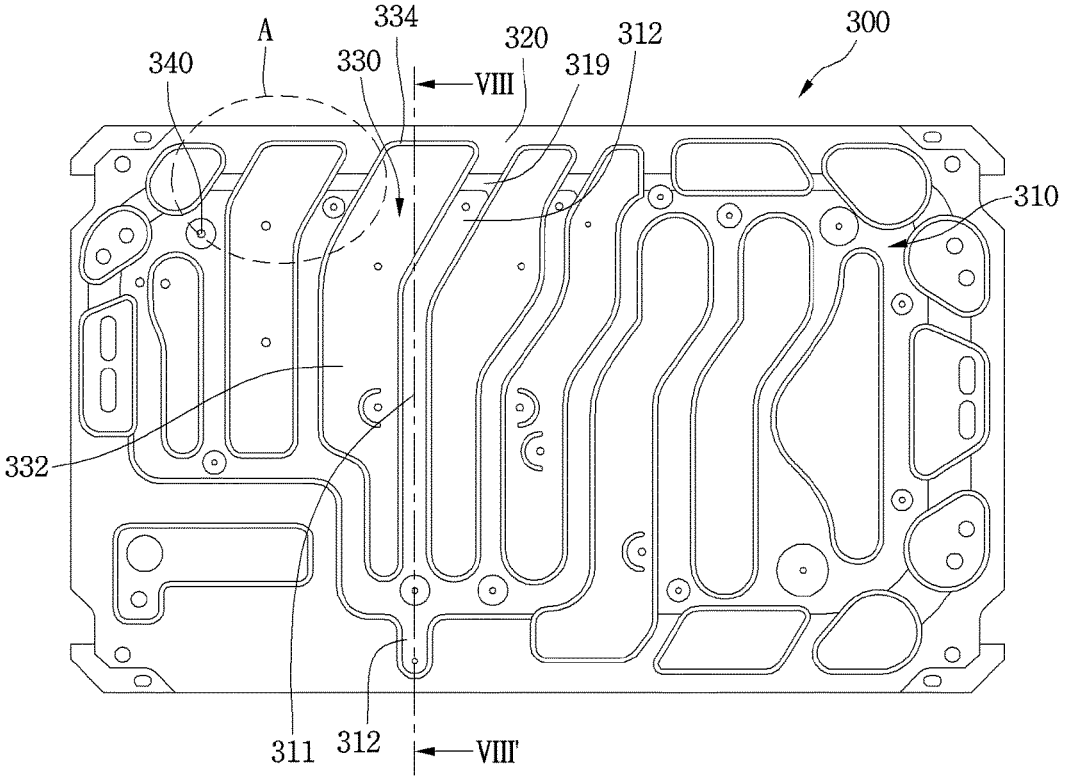
FIG. 7 is a plan view illustrating a convex portion of a base of an outdoor device according to another embodiment.
Figure 8:
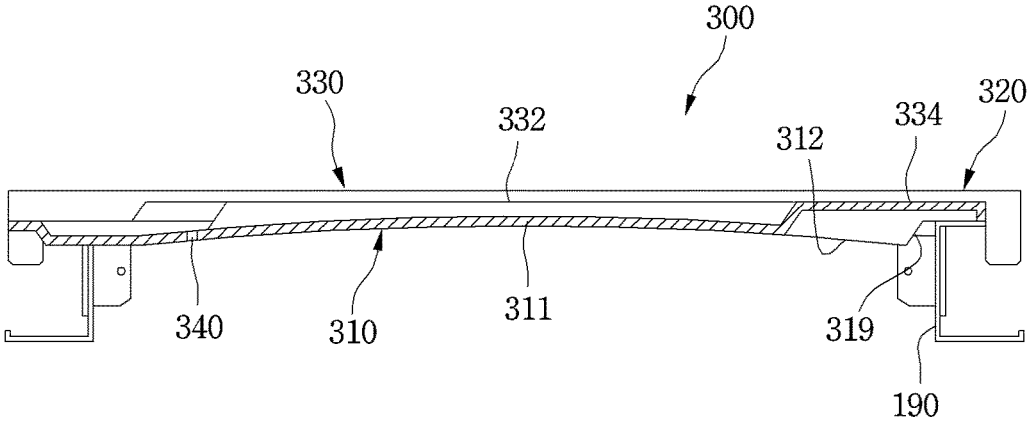
FIG. 8 is a cross-sectional view, taken along line VIII-VIII' of FIG. 7.

FIG. 7 is a plan view illustrating a convex portion of a base of an outdoor device according to another embodiment. FIG. 8 is a cross-sectional view, taken along line VIII-VIII' of FIG. 7.

Referring to FIGS. 7 and 8, a base 300 according to this embodiment may include a base body 310 that defines a lower outer appearance thereof, an edge portion 320 provided on or at an outside of the base body 310 to surround the base body 310, and a step 319 that defines a step difference between the base body 310 and the edge portion 320.

The step 319 may extend in an upward direction from a circumference of the base body 310. The edge portion 320 may extend in an outward direction from the step 319. As the edge portion 320 may have a height higher than a height of the base body 310, liquid existing in or contained within the base body 310 may be restricted or directed to flow into the edge portion 320.

The base 300 may include a seat 330, on which a plurality of components disposed in the outdoor device 10 may be seated. The seat 330 may include a first seat 332 that protrudes in the upward direction from the base body 310, and a second seat 334 that protrudes in the upward direction from the edge portion 320. A plurality of each of the first and second seats 332 and 334 may be provided.

The compressors 51 and 52, the oil separators 61 and 62, and the gas-liquid separator 80 may be supported by the first seat(s) 332. The heat exchanger 130 may be supported by the second seat(s) 334.

The first and second seats 332 and 334 may be integrated. The first and second seats 332 and 334 may have a same height. As the edge portion 320 may have a height which is higher than a height of the base body 310, a height by which the second seat 334 protrudes from the edge portion 320 may be less than a height by which the first seat 332 protrudes from the base body 310.

Also, as illustrated in FIG. 7, the second seat 334 may include an inclined surface inclined in a transversal or longitudinal direction on an outer surface thereof. For example, the second seat 334 may have a trapezoidal shape.

The base body 310 may have a convex shape that protrudes from lateral sides thereof toward a center thereof. The base body 310 may include a central portion 311 disposed at the center, and side portions 312 that extend from both sides of the central portion 311 with respect to one direction (a longitudinal direction of FIG. 7). The side portions 312 may include an edge of the base body 310.

The central portion 311 may have a height which is higher than a height of the side portions 312. In other words, the base body 310 may be convexly formed in the upward direction from the side portions 312 toward to the central portion 311, that is, the base body 310 may be inclined upward or rounded upward. The central portion 311 may be referred to as a "convex portion" of the base 300.

The first and second seats 332 and 334 may extend in parallel with a bottom surface of the installation space, for example, with respect to the ground. Thus, the plurality of components disposed on the first and second seats 332 and 334 may be stably supported on the first and second seats 332 and 334.

The base body 310 may include a plurality of drain holes 340, through which the liquid existing in or contained within the base body 310 may be discharged in the downward direction. The plurality of drain holes 340 may be defined in the side portions 312 and spaced apart from each other.

As the base body 310 may extend at an incline in the downward direction from the central portion 311 toward the side portions 312, the liquid existing in or contained within the base body 310 may flow into the side portions 312. The liquid may be easily discharged through the plurality of drain holes 340 defined in the side portions 312.

As the central portion 311 of the base body 310 has the upward convex shape, the seat 330 may prevent the base body 310 from being bent in a predetermined direction. The seat 330 may be formed by processing at least a portion of the base body 310, for example, by a forging process. During the processing, the central portion 311 of the base body 310 may be concavely deformed downward. To prevent this deformation, the central portion 311 of the base body 310 may have the upward convex shape.

Of course, the base body 310 may vary in size according to a capacity or size of the outdoor device. Also, the base body 310 may be convexly deformed upward by the seat 330. In this case, a following base structure according to a still another embodiment may be adopted.

Figure 9:
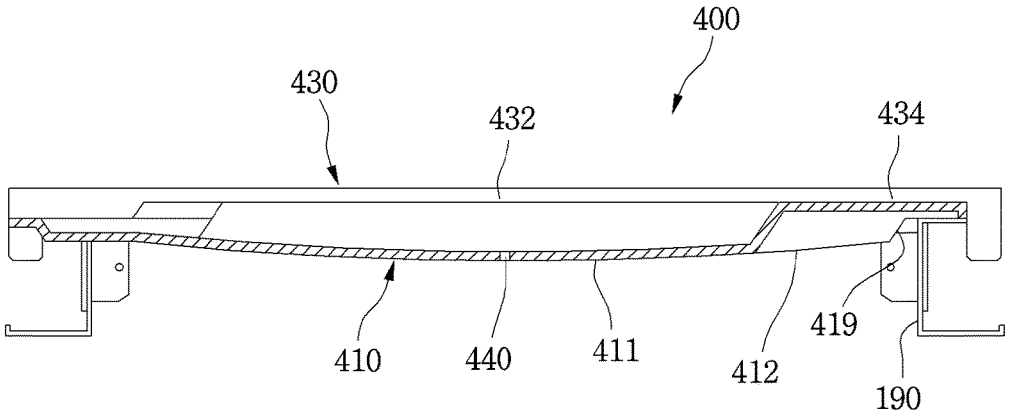
FIG. 9 is a cross-sectional view illustrating a concave portion of a base of an outdoor device according to still another embodiment.

FIG. 9 is a cross-sectional view illustrating a concave portion of a base of an outdoor device according to still another embodiment. Referring to FIG. 9, a base 400 according to this embodiment may include a base body 410 that defines a lower outer appearance thereof, an edge portion 420 provided on or at an outside of the base body 410 to surround the base body 410, and a step 419 that defines a step difference between the base body 410 and the edge portion 420.

The step 419 may extend in an upward direction from a circumference of the base body 410. The edge portion 420 may extend in an outward direction from the step 419. The edge portion 420 may be disposed higher than the base body 410.

The base 400 may include a seat 430, on which a plurality of components disposed in the outdoor device 10 may be seated. The seat 430 may include a first seat 432 that protrudes in the upward direction from the base body 410, and a second seat 434 that protrudes in the upward direction from the edge portion 420.

The compressors 51 and 52, the oil separator 61 and 62, and the gas-liquid separator 80 may be supported on the first seat 432. The heat exchanger 130 may be supported on the second seat 434.

The first and second seats 432 and 434 may be integrated. The first and second seats 432 and 434 may have a same height.

The base body 410 may have a concave shape recessed from sides thereof toward a center thereof. The base body 410 may include a central portion 411 disposed at the center, and side portions 412 that extend from both sides of the central portion 411 with respect to one direction (a transversal direction of FIG. 9). The side portions 412 may include an edge of the base body 410.

The central portion 411 may have a height which is less than a height of the side portions 412. In other words, the base body 410 may be concavely formed downward from the side portions 412 toward the central portion 412, that is, inclined downward or rounded downward. The central portion 411 may be referred to as a "concave portion" of the base 400.

The first and second seats 432 and 434 may extend in parallel with a bottom surface of the installation space, for example, with respect to the ground.

The base body 410 may include a plurality of drain holes 440, through which liquid existing in or contained within the base body 410 may be discharged in the downward direction. The plurality of drain holes 440 may be defined in the central portion 411 and spaced apart from each other.

As the base body 410 may extend at an incline downward from the side portions 412 toward the central portion 411, the liquid existing in or contained within the base body 410 may flow into the central portion 411. Also, the liquid may be easily discharged through the plurality of drain holes 440 defined in the central portion 411.

Figure 10:
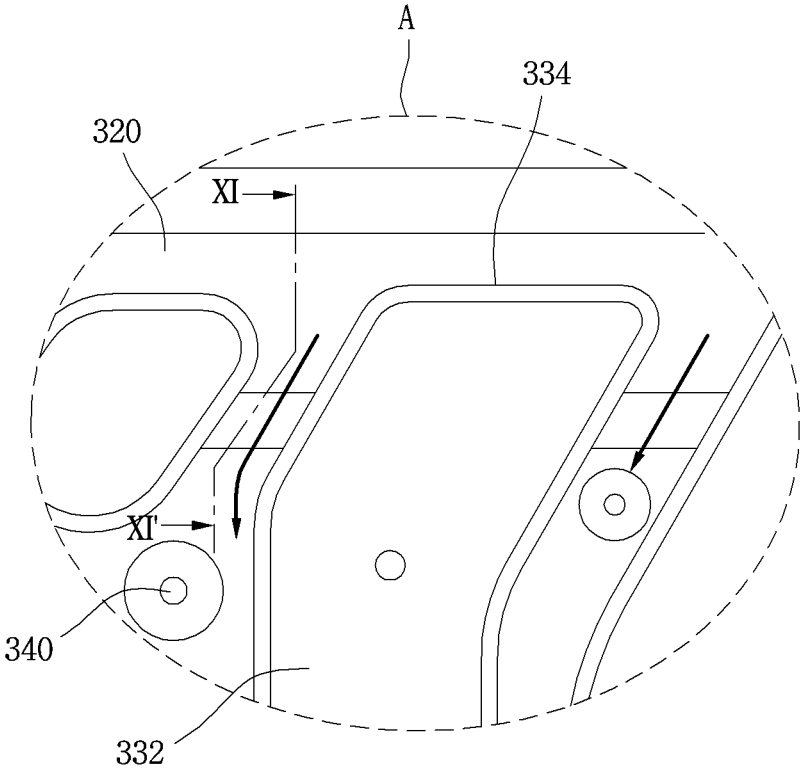
FIG. 10 is an enlarged view of a portion "A" of FIG. 7.
Figure 11:
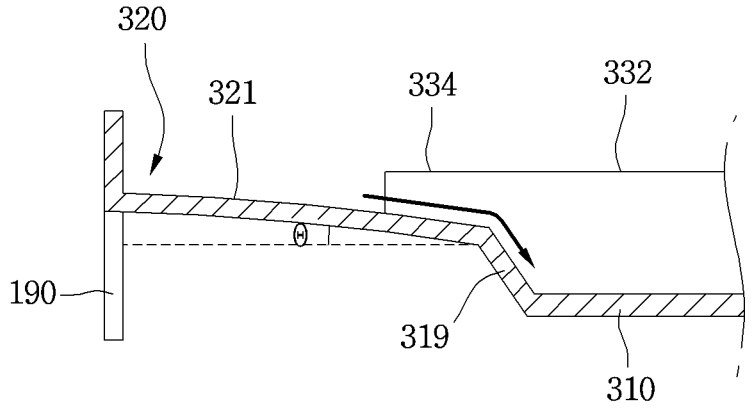
FIG. 11 is a cross-sectional view, taken along line XI-XI' of FIG. 10.

FIG. 10 is an enlarged view of a portion "A" of FIG. 7. FIG. 11 is a cross-sectional view, taken along line X-X' of FIG. 10.

Referring to FIGS. 10 and 11, the base 300 according to this embodiment may include the base body 310, in which the drain holes 340 may be defined, and the edge portion 320 that extends at an incline toward the base body 310 to guide the flow of the liquid. The edge portion 320 may include an inclined surface 321 that extends at an incline downward from an outer portion of the edge portion 320 toward an inner portion of the edge portion 320. The inner portion represents a portion connected to the step 319, and the outer portion represents a portion opposite to the inner portion. Also, the inclined surface 321 may define a top surface of the edge portion 320. Also, as illustrated in FIG. 11, as the step 319 may extend at the incline from the edge portion 320 toward the base body 310, the flow of liquid may be guided from the edge portion 320 into the base body 310. That is, the inclined surface 321 may extend at the incline downward toward the base body 310 or the drain holes 340.

As illustrated in FIG. 11, an angle of the inclined surface 321 with respect to a horizontal surface may be defined as a predetermined angle θ. The inclined surface 321 may be provided between the plurality of second seats 334 that protrudes in the upward direction from the edge portion 320. Also, the heat exchanger 130 may be seated on the second seat 334. The second seat 334 may have a surface that extends in parallel with a horizontal surface, that is, with the ground.

As the edge portion 320 may include the inclined surface 321 that extends at an incline downward toward the base body 310, the liquid existing in or contained within the edge portion 320, for example, defrost water generated by the heat exchanger 130 may be introduced into the base body 310.

Also, the liquid introduced into the base body 310 may be guided to the drain holes 340 of the base body 310, and then, may be easily discharged downward from the base 300. That is, the inclined surface 321 may guide the flow of the liquid into the drain holes 340 of the base body 310.

Each of the blocking portion 250, the central portion 311 having the convex portion, the central portion 411 having the concave portion 411, and the inclined surface 321 of the edge portion 320 described in the above embodiments may be referred to as a "guide" as the liquid existing in or contained within the outdoor device may be guided so that the liquid flows into the drain holes.

According to embodiments disclosed herein, as the guide may be disposed on the base, the liquid existing in or contained within the outdoor device may be easily discharged to the drain holes. In particular, the guide may include the blocking portion disposed on the edge of the base to prevent the liquid from being introduced into the base body and to guide the liquid to the drain holes defined in the edge portion.

Further, as the guide may have a convex portion in which the central portion of the base body is convexly formed or the concave portion in which the central portion of the base body is concavely formed, the liquid existing in or contained within the base body may be easily guided toward the drain holes. Furthermore, according to the shape of the convex portion or the concave portion, a phenomenon in which the base is bent in a predetermined direction when the base is assembled may be prevented. Also, as the guide may include the inclined surface on the edge portion of the base, the liquid existing in or contained within the edge portion of the base may flow into the base body, and thus, may be easily discharged to the drain holes.

Embodiments disclosed herein provide an outdoor device for an air conditioner, in which a liquid existing in or contained within the outdoor device may be smoothly discharged.

Embodiments disclosed herein provide an outdoor unit or device for an air conditioner that may include a cabinet, and a base disposed on or at a lower portion of the cabinet. The base may include a base body on which a first seat part or seat that supports a compressor may be disposed; an edge part or portion disposed along a circumference of the base body and on which a second seat part or seat that supports a heat exchanger may be disposed; and one or more drain holes defined in the base body to guide discharge of water existing in or contained within the base. The first and second seat parts may be integrated with each other.

The edge part may include an edge body, and the first seat part may protrude from the base body, and the second seat part may protrude from the edge body. The first and second seat part may have a same height. The edge body may have a height higher than a height of the base body. The outdoor unit may further include a stepped part or step that extends upward from the base body toward the edge body to restrict or direct a liquid in the base body to flow into the edge body.

A height by which the second seat part protrudes from the edge body may be less than a height by which the first seat part protrudes from the base body. The edge body may include an inclined surface that guides a flow of the liquid toward the drain holes on a top surface thereof.

The base body may include a central portion, and side portions that extend from both sides of the central portion. The central portion may have a height different from a height of each of the side portions. The base body may be convexly formed upward from the side portions toward the central portion thereof. The drain holes may be defined in the side portions.

The base body may be concavely formed downward from the side portions toward the central portion thereof. The drain holes may be defined in the central portion.

Embodiments disclosed herein further provide an outdoor unit or device for an air conditioner that may include a cabinet, and a base disposed on a lower portion of the cabinet. The base may include a base body on which a first seat part or seat that supports a compressor may be disposed; an edge part or portion disposed along a circumference of the base body and on which a second seat part or seat that supports a heat exchanger may be disposed; one or more drain holes defined in the base body to guide discharge of water existing in or contained within the base; and an inclined surface that defines a top surface of the edge part, the inclined surface being inclined downward to extend toward the base body.

The outdoor unit may further include a stepped part or step that extends upward from the base body toward the edge part. A plurality of the second seat part may be provided, and the inclined surface may be disposed between the plurality of second seat parts of the edge part.

The edge part may further include an edge body. The second seat part may protrude upward from the edge body.

Embodiments disclosed herein further provide an outdoor unit or device for an air conditioner that may include a cabinet including a suction panel, and a base disposed on a lower portion of the cabinet. The base may include a base body, on which a first seat part or seat that supports a compressor may be disposed; an edge part or portion disposed along a circumference of the base body and on which a second seat part or seat that supports a heat exchanger may be disposed; one or more drain holes defined in the base body to guide discharge of water existing in the base; and a stepped part or step that extends upward from the base body toward the edge part to restrict water existing in the base body to flow into the edge part. The edge part may further include an edge body, and the second seat part may protrude upward from the edge body.

Embodiments disclosed herein further provide an outdoor unit or device for an air conditioner that may include a cabinet; and a base disposed on a lower portion of the cabinet. The base may include a base body on which a first seat part or seat that supports a compressor may be disposed; a drain hole defined in the base body; a stepped part or step that extends upward from the base body; and an edge part or portion connected to the stepped part and on which an edge body and a second seat part or set that protrudes upward from the edge body may be disposed.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An outdoor device for an air conditioner, the outdoor device comprising:

a cabinet; and a base provided at a lower portion of the cabinet, wherein the base includes:

a base body on which at least one first seat that supports at least one compressor is provided;

an edge portion provided along a circumference of the base body and on which at least one second seat that supports a heat exchanger is provided; wherein the at least one first seat and the at least one second seat are integrated with each other, wherein the base body includes:

a central portion; and side portions that extend from both sides of the central portion, wherein the central portion has a height different from a height of each of the side portions, and wherein the base body is convexly formed in an upward direction from the side portions toward the central portion thereof, or the base body is concavely formed in a downward direction from the side portions toward the central portion thereof.

2. The outdoor device according to claim 1, further comprising one or more drain holes defined in the base body to guide discharge of liquid from the base.

3. The outdoor device according to claim 1, wherein the edge portion includes an edge body, and wherein the at least one first seat protrudes from the base body, and the at least one second seat protrudes from the edge body.

4. The outdoor device according to claim 3, wherein the at least one first seat and the at least one second seat have a same height.

5. The outdoor device according to claim 3, wherein the edge body has a height higher than a height of the base body.

6. The outdoor device according to claim 3, further including a step that extends in an upward direction from the base body toward the edge body to prevent a liquid in the base body from flowing into the edge body.

7. The outdoor device according to claim 3, wherein a height by which the at least one second seat protrudes from the edge body is less than a height by which the at least one first seat protrudes from the base body.

8. The outdoor device according to claim 1, wherein the edge body includes on a top surface thereof an inclined surface to guide a flow of the liquid toward one or more drain holes.

9. The outdoor device according to claim 1, wherein one or more drain holes are defined in the side portions.

10. The outdoor device according to claim 1, wherein one or more drain holes is defined in the central portion.

11. An air conditioner including the outdoor device according to claim 1.

12. An outdoor device for an air conditioner, the outdoor device comprising:

a cabinet; and a base provided at a lower portion of the cabinet, wherein the base includes:

a base body on which at least one first seat that supports at least one compressor is provided;

an edge portion having a height higher than a height of the base body and on which a heat exchanger is disposed; and one or more drain holes defined in the base body to guide discharge of liquid from the base, wherein a top surface of the edge portion includes an inclined surface, wherein the inclined surface extends at a downward incline toward the base body, wherein the base body includes:

a central portion; and side portions that extend from both sides of the central portion, wherein the central portion has a height different from a height of each of the side portions, and wherein the base body is convexly formed in an upward direction from the side portions toward the central portion thereof or the base body is concavely formed in a downward direction from the side portions toward the central portion thereof.

13. The outdoor device according to claim 12, further including a step that extends in an upward direction from the base body toward the edge portion.

14. The outdoor device according to claim 12, further comprising a plurality of second seats, and wherein the inclined surface is provided between the plurality of second seats of the edge portion.

15. The outdoor device according to claim 12, wherein the edge portion further includes an edge body, and wherein at least one second seat protrudes in an upward direction from the edge body.

16. An air conditioner including the outdoor device according to claim 12.

17. An outdoor device for an air conditioner, the outdoor device comprising:

a cabinet including at least one suction panel; and a base provided at a lower portion of the cabinet, wherein the base includes:

a base body on which at least one first seat that supports at least one compressor is provided;

an edge portion provided along a circumference of the base body and on which at least one second seat that supports a heat exchanger is disposed;

one or more drain holes defined in the base body to guide discharge of liquid from the base; and a step that extends in an upward direction from the base body toward the edge portion to prevent liquid on the base body from flowing into the edge portion, wherein the base body includes:

a central portion; and side portions that extend from both sides of the central portion, wherein the central portion has a height different from a height of each of the side portions, and wherein the base body is convexly formed in an upward direction from the side portions toward the central portion thereof, or the base body is concavely formed in a downward direction from the side portions toward the central portion thereof.

18. The outdoor device according to claim 17, wherein the step is inclined at a predetermined angle with respect to the base body.

19. The outdoor device according to claim 17, wherein the edge portion includes an edge body, and wherein the at least one second seat protrudes in the upward direction from the edge body.

20. The outdoor device according to claim 17, further comprising an inclined surface configured to extend at a downward incline toward the base body.

21. An air conditioner including the outdoor device according to claim 17.

22. An outdoor device for an air conditioner, the outdoor device comprising:

a cabinet; and a base provided at a lower portion of the cabinet, wherein the base includes:

a base body on which at least one first seat that supports at least one compressor is provided;

a step that extends in an upward direction from the base body; and an edge body connected to the step and extended outwardly with respect to the base body;

at least one second seat that protrudes in the upward direction from the edge body; and a heat exchanger disposed on the at least one second seat, wherein the base body includes:

a central portion; and side portions that extend from both sides of the central portion, wherein the central portion has a height different from a height of each of the side portions, and wherein the base body is convexly formed in an upward direction from the side portions toward the central portion thereof, or the base body is concavely formed in a downward direction from the side portions toward the central portion thereof.

23. The outdoor device according to claim 22, wherein the edge body surrounds the base body.

24. The outdoor device according to claim 22, further comprising an inclined surface configured to extend at a downward incline toward the base body.

25. An air conditioner including the outdoor device according to claim 22.

26. A base for an outdoor device for an air conditioner, the base comprising:

a base body on which at least one first seat configured to support at least one compressor is provided;

an edge portion provided along a circumference of the base body and on which at least one second seat configured to support a heat exchanger is provided; and one or more drain holes defined in the base body to guide discharge of liquid from the base, wherein the at least one first seat and the at least one second seat are integrated with each other, wherein the base body includes:

a central portion; and side portions that extend from both sides of the central portion, wherein the central portion has a height different from a height of each of the side portions, and wherein the base body is convexly formed in an upward direction from the side portions toward the central portion thereof, or the base body is concavely formed in a downward direction from the side portions toward the central portion thereof.

27. An outdoor device including the base according to claim 26.

28. A base for an outdoor device for an air conditioner, the base comprising:

a base body on which at least one first seat configured to support at least one compressor is provided;

an edge portion having a height higher than a height of the base body and on which at least one second seat configured to support a heat exchanger is disposed; and one or more drain holes defined in the base body to guide discharge of liquid from the base, wherein a top surface of the edge portion includes an inclined surface, and wherein the inclined surface extends at a downward incline toward the base body, wherein the base body includes:

a central portion; and side portions that extend from both sides of the central portion, wherein the central portion has a height different from a height of each of the side portions, and wherein the base body is convexly formed in an upward direction from the side portions toward the central portion thereof, or the base body is concavely formed in a downward direction from the side portions toward the central portion thereof.

29. An outdoor device including the base according to claim 28.

30. A base for an outdoor device for an air conditioner, the base comprising:

a base body on which at least one first seat configured to support at least one compressor is provided;

an edge portion provided along a circumference of the base body and on which at least one second seat configured to support a heat exchanger is disposed;

one or more drain holes defined in the base body to guide discharge of liquid from the base; and a step that extends in an upward direction from the base body toward the edge portion to prevent liquid on the base body from flowing into the edge portion, wherein the base body includes:

a central portion; and side portions that extend from both sides of the central portion, wherein the central portion has a height different from a height of each of the side portions, and wherein the base body is convexly formed in an upward direction from the side portions toward the central portion thereof, or the base body is concavely formed in a downward direction from the side portions toward the central portion thereof.

31. An outdoor device including the base according to claim 30.

32. A base for an outdoor device for an air conditioner, the base comprising:

a base body on which at least one first seat configured to support at least one compressor is provided;

at least one drain hole defined in the base body;

a step that extends in an upward direction from the base body; and an edge portion connected to the step and including an edge body and at least one second seat that protrudes in the upward direction from the edge body, wherein the base body includes:

a central portion; and side portions that extend from both sides of the central portion, wherein the central portion has a height different from a height of each of the side portions, and wherein the base body is convexly formed in an upward direction from the side portions toward the central portion thereof, or the base body is concavely formed in a downward direction from the side portions toward the central portion thereof.

33. An outdoor device including the base according to claim 32.

* * * * *